US010480857B2

(12) United States Patent
Edgerton

(10) Patent No.: US 10,480,857 B2
(45) Date of Patent: Nov. 19, 2019

(54) SEED DRYING SYSTEM

(71) Applicant: Brett Edgerton, Sioux Falls, SD (US)

(72) Inventor: Brett Edgerton, Sioux Falls, SD (US)

( * ) Notice: Subject to any disclaimer, the term of this patent is extended or adjusted under 35 U.S.C. 154(b) by 254 days.

(21) Appl. No.: 15/604,198

(22) Filed: May 24, 2017

(65) Prior Publication Data

US 2018/0340732 A1 Nov. 29, 2018

(51) Int. Cl.

| | |
|---|---|
| ***F26B 11/02*** | (2006.01) |
| ***F26B 11/04*** | (2006.01) |
| ***F26B 21/00*** | (2006.01) |

(52) U.S. Cl.

CPC ..... *F26B 11/028* (2013.01); *F26B 11/04* (2013.01); *F26B 21/004* (2013.01); *F26B 2200/06* (2013.01)

(58) Field of Classification Search

CPC ..... F26B 11/028; F26B 11/04; F26B 21/004; F26B 2200/06

See application file for complete search history.

(56) References Cited

U.S. PATENT DOCUMENTS

| | | | |
|---|---|---|---|
| 4,356,934 | A | 11/1982 | Knake |
| 4,465,017 | A | 8/1984 | Simmons |
| 5,087,475 | A | 2/1992 | Bazin et al. |
| 5,494,709 | A | 2/1996 | Long, Jr. et al. |
| 5,721,012 | A | 2/1998 | Long, Jr. et al. |
| 6,202,346 | B1 | 3/2001 | Lyons et al. |

FOREIGN PATENT DOCUMENTS

| | | | |
|---|---|---|---|
| CN | 204069677 | 1/2015 | |
| CN | 20140869792 | 6/2015 | |
| GB | 191003604 A | * 10/1910 | ..... A23B 9/18 |
| WO | WO0123820 | 5/2001 | |

* cited by examiner

*Primary Examiner* — Jessica Yuen

(57) ABSTRACT

A seed drying system for positioning a manifold in a seed treater includes a seed treater that contains a plurality of seeds that have been coated with a liquid treatment. A manifold is positioned within the seed treater and a fan is provided to selectively urge air. The fan is fluidly coupled to the manifold to direct the air over the seeds thereby facilitating the liquid treatment to dry on the seeds. A mounting unit is provided and the manifold is coupled to the mounting unit such that the mounting unit retains the manifold in a horizontal orientation. The mounting unit is releasably coupled to the housing such that the manifold is retained in the drum. Moreover, the mounting unit centrally positions the manifold in the aperture.

17 Claims, 5 Drawing Sheets

SEED DRYING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to drying devices and more particularly pertains to a new drying device for positioning a manifold in a seed treater.

BRIEF SUMMARY OF THE INVENTION

An embodiment of the disclosure meets the needs presented above by generally comprising a seed treater that contains a plurality of seeds that have been coated with a liquid treatment. A manifold is positioned within the seed treater and a fan is provided to selectively urge air. The fan is fluidly coupled to the manifold to direct the air over the seeds thereby facilitating the liquid treatment to dry on the seeds. A mounting unit is provided and the manifold is coupled to the mounting unit such that the mounting unit retains the manifold in a horizontal orientation. The mounting unit is releasably coupled to the housing such that the manifold is retained in the drum. Moreover, the mounting unit centrally positions the manifold in the aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
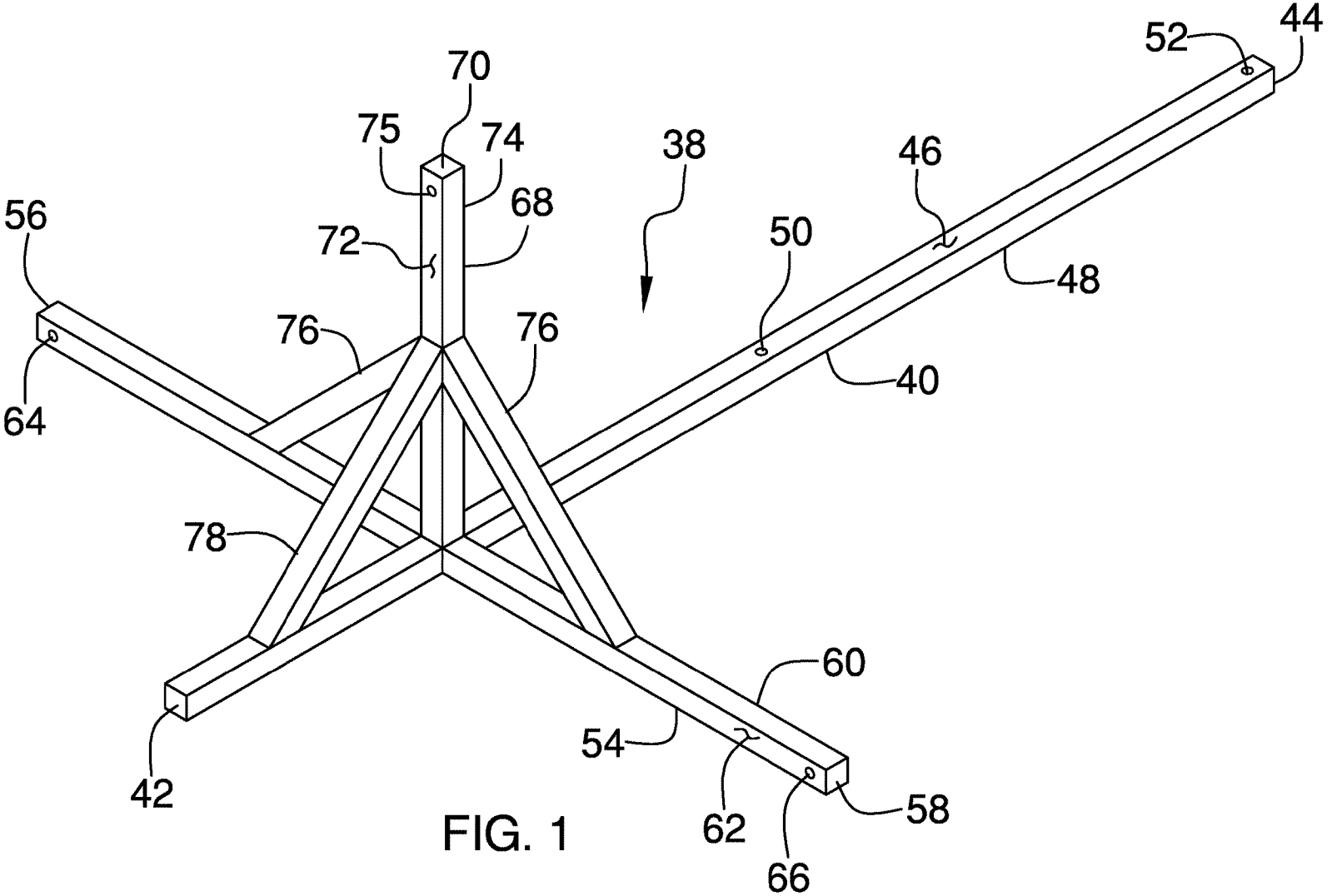
FIG. 1 is a top perspective view of mounting unit of a seed drying system according to an embodiment of the disclosure.
Figure 2:
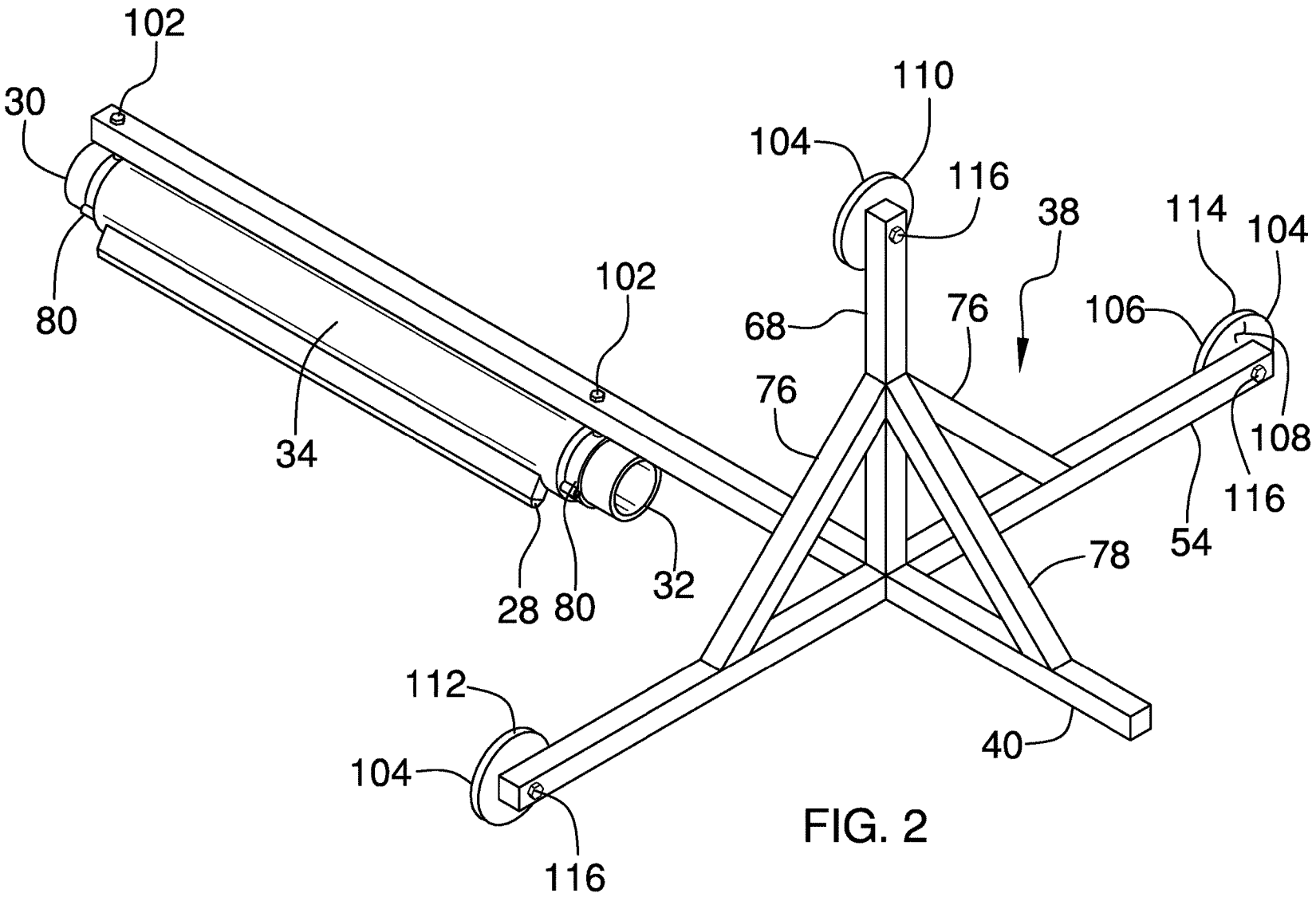
FIG. 2 is a back perspective view of a mounting unit, a manifold and a plurality of disks of an embodiment of the disclosure.
Figure 3:
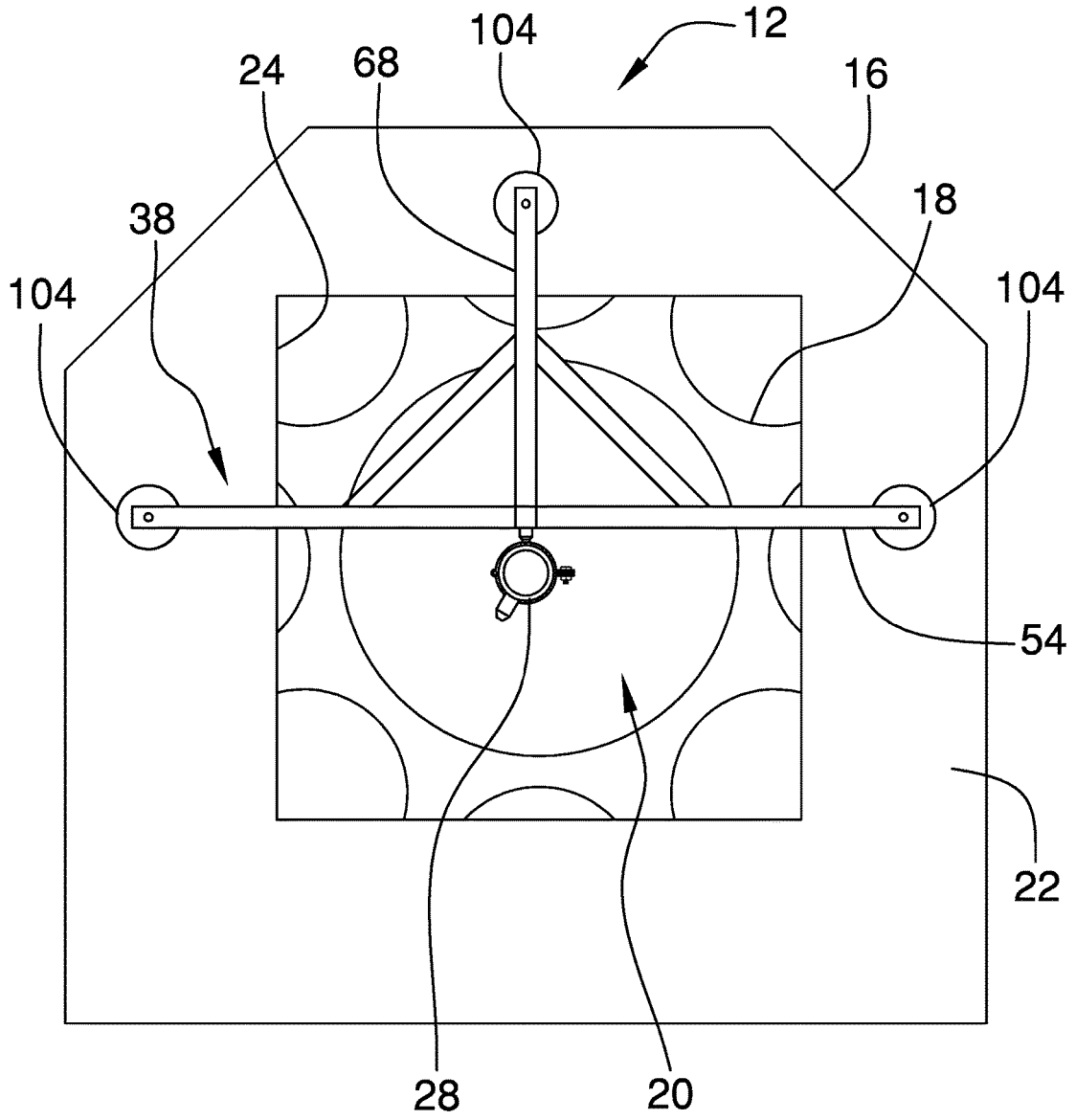
FIG. 3 is a rear perspective in-use view of an embodiment of the disclosure.
Figure 4:
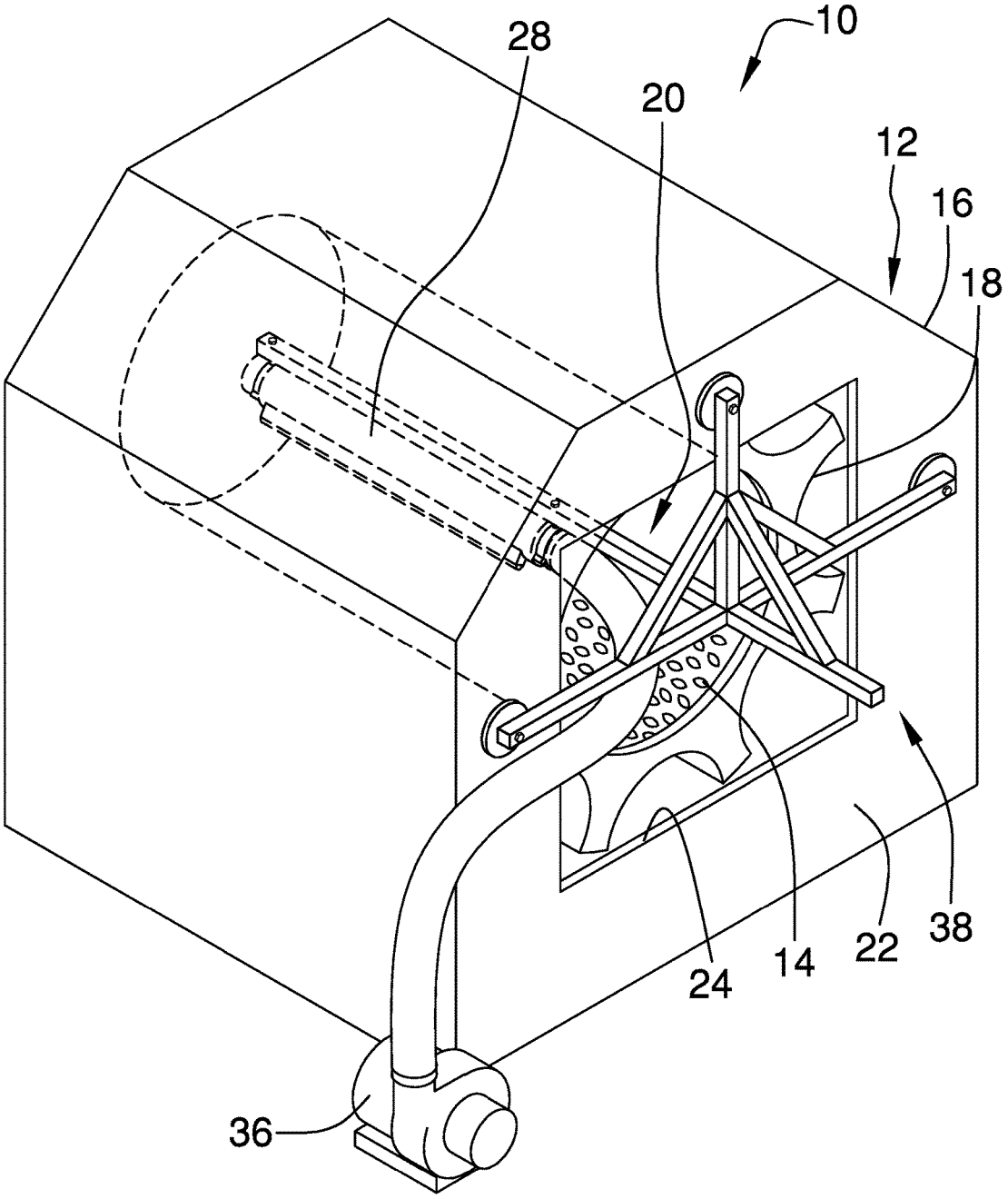
FIG. 4 is a phantom perspective in-use view of an embodiment of the disclosure.
Figure 5:
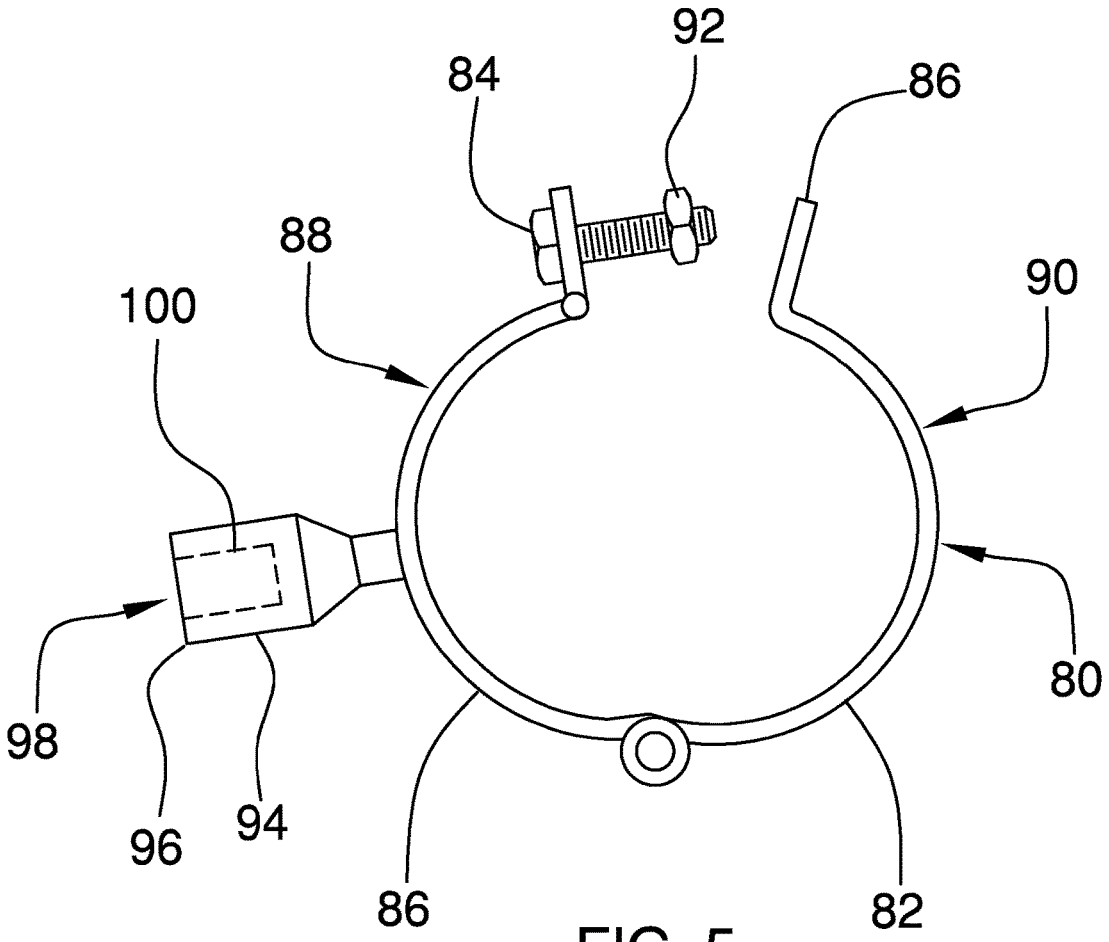
FIG. 5 is a perspective view of a clamp of an embodiment of the disclosure.

With reference now to the drawings, and in particular to FIGS. 1 through 5 thereof, a new drying device embodying the principles and concepts of an embodiment of the disclosure and generally designated by the reference numeral 10 will be described.

As best illustrated in FIGS. 1 through 5, the seed drying system 10 generally comprises a seed treater 12 that may contain a plurality of seeds 14. Each of the seeds 14 may have been coated with a liquid treatment. The seeds 14 may be soybeans or any other seeds 14 that are planted for agricultural purposes. The liquid treatment may be a liquid fertilizer, a liquid insecticide or any other liquid treatment commonly used in treating agricultural seeds 14.

The seed treater 12 has a housing 16 and a drum 18 that is rotatably positioned within the housing 16. The drum 18 has an aperture 20 extending longitudinally through the drum 18 and the aperture 20 contains the seeds 14. The housing 16 has a first wall 22 and the first wall 22 has an opening 24 extending into an interior of the housing 16. The drum 18 is oriented having the aperture 20 being aligned with the opening 24 and the first wall 22 has an outer surface 26. Moreover, the seed treater 12 may be a seed treater 12 manufactured by Universal Seed Care, LLC, 2320 $124^{th}$ Road, Sabetha, Kans., 66534.

A manifold 28 is provided and the manifold 28 is positioned within the seed treater 12. Moreover, the manifold 28 is positioned within the aperture 20 in the drum 18. The manifold 28 has a primary end 30, a secondary end 32 and an outer wall 34 extending therebetween. The manifold 28 is elongated between the primary end 30 and the secondary end 32, and the outer wall 34 is continuous such that the manifold 28 has a cylindrical shape. The manifold 28 may be an air knife manufactured by Air Control Industries Inc, 76 Rockland Road, Windsor, Me., 04348.

A fan 36 is provided and the air selectively urges air. The fan 36 is fluidly coupled to the manifold 28 such that the manifold 28 directs the air over the seeds 14. In this way the liquid treatment is dried on the seeds 14. The fan 36 may be a backward curved, single inlet centrifugal fan manufactured by Air Control Industries Inc, 76 Rockland Road, Windsor, Me., 04348. A conduit is provided and the conduit is fluidly coupled between the fan 36 and the manifold 28.

A mounting unit 38 is provided and the manifold 28 is coupled to the manifold 28. The mounting unit 38 retains the manifold 28 in a horizontal orientation. The mounting unit 38 is releasably coupled to the housing 16 such that the manifold 28 is retained in the drum 18. Moreover, the mounting unit 38 centrally positions the manifold 28 in the aperture 20.

The mounting unit 38 comprises a first member 40 that has a first end 42 and a second end 44, and the first member 40 is elongated between the first end 42 and the second end 44. The first member 40 may have a length ranging between approximately 127.0 cm and 152.0 cm. The first member 40 has a top surface 46 and a bottom surface 48. The first member 40 has a first aperture 50 extending through the top surface 46 and the bottom surface 48 and the first aperture 50 is centrally positioned between the first end 42 and the second end 44. The first member 40 has a second aperture 52 extending through the top surface 46 and the bottom surface 48 and the second aperture 52 is positioned closer to the second end 44 than the first aperture 50.

The mounting unit 38 includes a second member 54 that has a first end 56 and a second end 58. The second member 54 has a front surface 60 and a back surface 62, and the second member 54 is elongated between the first end 56 and the second end 58 of the second member 54. The second member 54 is coupled to the first member 40 and the second member 54 is oriented perpendicular to the first member 40. The second member 54 is positioned closer to the first end 42 of the first member 40 than the second end 44 of the first member 40 such that the first 40 and second 54 members form a cross.

The first member 40 is centrally positioned on the second member 54. The second member 54 may have a length ranging between approximately 88.0 cm and 101.0 cm. Additionally, the second member 54 may be spaced from the first end 42 of the first member 40 a distance ranging between approximately 25.0 cm and 40.0 cm. The second member 54 has a third aperture 64 extending through the front surface 60 and the back surface 62. The third aperture 64 is positioned closer to the first end 56 of the second member 54 than the second end 58 of the second member 54. The second member 54 has a fourth aperture 66 extending through the front surface 60 and the back surface 62. Additionally, the fourth aperture 66 is positioned closer to the second end 58 of the second member 54 than the first end 56 of the second member 54.

The mounting unit 38 includes a third member 68 that is coupled to and extends upwardly from an intersection between the first member 40 and the second member 54. The third member 68 is oriented perpendicular to each of the first member 40 and the second member 54. The third member 68 has a distal end 70 with respect to the intersection and the third member 68 may have a length ranging between approximately 38.0 cm and 50.0 cm.

The third member 68 has a rear surface 72 and a forward surface 74. The third member 68 has a fifth aperture 75 extending through the rear surface 72 and the forward surface 74. The mounting unit 38 is positioned in the housing 16 having the first member 40 extending through the opening 24 in the housing 16. Additionally, the first member 40 is centrally positioned in the aperture 20 in the drum 18 having the first member 40 being horizontally oriented in the drum 18.

A pair of first supports 76 is provided and each of the first supports 76 is coupled to and extends between the third member 68 and the second member 54. Each of the supports is positioned on opposite sides of the third member 68. In this way each of the supports inhibits the third member 68 from laterally deflecting from the third member's 68 perpendicular orientation. A second support 78 is coupled to and extends between the third member 68 and the first member 40. In this way the second support 78 inhibits the third member 68 from deflecting rearwardly and forwardly from the third member 68's perpendicular orientation. Additionally, the second support 78 is positioned on the rear surface 72 of the third member 68 such that the second support 78 does not engage the housing 16.

A plurality of clamps 80 is provided and each of the clamps 80 is removably coupled to the first member 40. Each of the clamps 80 releasably engages the manifold 28 such that the manifold 28 is retained on the first member 40. Additionally, the manifold 28 is oriented collinear with the first member 40. Each of the clamps 80 comprises a strap 82 that has a primary end 84 and a secondary end 86. The strap 82 is curved between the primary 84 and secondary 86 ends of the strap 82 such that the strap 82 has a circular shape.

The strap 82 is divided into a first half 88 that is hingedly coupled to a second half 90. The strap 82 is positioned in an open position having the primary end 84 of the strap 82 being spaced from the secondary end 86 of the strap 82. In this way the strap 82 receives the manifold 28. The strap 82 is positioned in a closed position having primary end 84 of the strap 82 abutting the secondary end 84 of the strap 82. In this way the strap 82 is wrapped around the outer wall 34 of the manifold 28.

A first fastener 92 is pivotally coupled to the primary end 30 of the strap 82. The first fastener 92 engages the secondary end 86 of the strap 82 to compress the strap 82 around the manifold 28. The first fastener 92 may comprise a bolt or other mechanical fastener. A receiver 94 is coupled to the strap 82 and the receiver 94 has a distal end 96 with respect to the strap 82. The receiver 94 extends away from the manifold 28 when the strap 82 is wrapped around the manifold 28. Moreover, the distal end 96 of the receiver 94 has a well 98 extending toward the strap 82 and the well 98 has a bounding surface 100.

A second fastener 102 is provided and the second fastener 102 is extended through a selected one of the first 50 and second 52 apertures in the first member 40. The second fastener 102 threadably engages the bounding surface 100 of the well 98. In this way the strap 82 is coupled to the first member 40 thereby facilitating the manifold 28 to be coupled to the first member 40 when the strap 82 is wrapped around the manifold 28. The second fastener 102 may be a bolt or the like.

A plurality of disks 104 is provided and each of the disks 104 has a first surface 106 and a second surface 108. The second surface 108 corresponding to each of the disks 104 are coupled the mounting unit 38. Moreover, the first surface 106 corresponding to each of the disks 104 magnetically engages the outer surface 26 of the housing 16 corresponding to the seed treater 12. In this way the mounting unit 38 is releasably coupled to the housing 16.

The plurality of disks 104 includes a first disk 110, a second disk 112 and a third disk 114. The first disk 110 is positioned on the forward surface 74 of the third member 68. Each of the third 114 and second 112 disks is positioned on the front surface 60 of the second member 54. A plurality of third fasteners 116 is provided and each of the third fasteners 116 engages an associated one of the disks 104. The third fastener 116 corresponding to the first disk 110 is extended through the fifth aperture 75 in the third member 68. The third fastener 116 corresponding to the second disk 112 is extended through the third aperture 64 in the second member 54. The third member 68 corresponding to the third disk 114 is extended through the fourth aperture 66 in the second member 54.

In use, each clamps 80 is coupled to the manifold 28 and the receiver 94 corresponding to each of the clamps 80 is coupled to the first member 40. The mounting unit 38 is positioned on the seed treater 12 such that the first member 40 extends through the aperture 20 in the drum 18. Additionally, the mounting unit 38 is positioned on the housing 16 to centrally position the manifold 28 in the drum 18 thereby facilitating the manifold 28 to dry the seeds 14 in accordance with the manufacturer's specifications. Each of the disks 104 magnetically engages the housing 16 to retain the mounting unit 38 on the seed treater 12. In this way the mounting unit 38 is releasably coupled to the seed treater 12 without the use of penetrating fasteners or other mechanical fasteners. Thus, the mounting unit 38 does not inhibit rotation of the drum 18 in the housing 16. The mounting unit 38 is removable at any time from the housing 16 thereby facilitating the seed treater 12 to be serviced and cleaned.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A seed drying system comprising:

a seed treater being configured to contain a plurality of seeds that have been coated with a liquid treatment, said seed treater having a housing and a drum being rotatably positioned within said housing, said drum having an aperture extending longitudinally through said drum wherein said aperture is configured to contain the seeds;

a manifold being positioned within said seed treater;

a fan being configured to selectively urge air, said fan being fluidly coupled to said manifold wherein said manifold is configured to direct the air over the seeds thereby facilitating the liquid treatment to dry on the seeds; and a mounting unit having said manifold being coupled thereto such that said mounting unit retains said manifold in a horizontal orientation, said mounting unit being releasably coupled to said housing such that said manifold is retained in said drum, said mounting unit centrally positioning said manifold in said aperture, said mounting unit comprising a first member having a first end and a second end, said first member being elongated between said first end and said second end, said first member having a top surface and a bottom surface, said first member having a first aperture extending through said top surface and said bottom surface, said first aperture being centrally positioned between said first end and said second end, said first member having a second aperture extending through said top surface and said bottom surface, said second aperture being positioned closer to said second end than said first aperture.

2. The system according to claim 1, wherein said housing has a first wall, said first wall having an opening extending into an interior of said housing, said drum being oriented having said aperture being aligned with said opening, said first wall having an outer surface.

3. The system according to claim 2, wherein said manifold is positioned within said aperture in said drum, said manifold having a primary end, a secondary end and an outer wall extending therebetween, said manifold being elongated between said first end and said second end, said outer wall being continuous such that said manifold has a cylindrical shape.

4. The system according to claim 1, further comprising a second member having a first end and a second end, said second member having a front surface and a back surface, said second member being elongated between said first end and said second end of said second member, said second member being coupled to said first member, said second member being oriented perpendicular to said first member, said second member being positioned closer to said first end of said first member than said second end of said first member such that said first and second members forms a cross, said first member being centrally positioned on said second member.

5. The system according to claim 4, wherein said second member has a third aperture extending through said front surface and said back surface, said third aperture being positioned closer to said first end of said second member than said second end of said second member, said second member having a fourth aperture extending through said front surface and said back surface, said fourth aperture being positioned closer to said second end of said second member than said first end of said second member.

6. The system according to claim 4, further comprising a third member being coupled to and extending upwardly from an intersection between said first member and said second member having said third member being oriented perpendicular to each of said first member and said second member, said third member having a distal end with respect to said intersection, said third member having a rear surface and a forward surface.

7. The system according to claim 6, wherein:

said seed treater includes a housing and a drum, said housing having an opening, said drum having an aperture; and said third member has a fifth aperture extending through said rear surface and said forward surface, said mounting unit being positioned in said housing having said first member extending through said opening in said housing and being centrally positioned in said aperture in said drum having said first member being horizontally oriented in said drum.

8. The system according to claim 7, further comprising a pair of first supports, each of said first supports being coupled to and extending between said third member and said second member, each of said supports being positioned on opposite sides of said third member such that each of said supports inhibits said third member from laterally deflecting from said third member's perpendicular orientation.

9. The system according to claim 7, further comprising a second support, said second support being coupled to and extending between said third member and said first member such that said second support inhibits said third member from deflecting rearwardly and forwardly from said third member's perpendicular orientation, said second support being positioned on said rear surface of said third member such that said second support does not engage said housing.

10. The system according to claim 1, further comprising a plurality of clamps, each of said clamps being removably coupled to said first member, each of said clamps releasably engaging said manifold such that said manifold is retained on said first member having said manifold being oriented collinear with said first member.

11. The system according to claim 10, further wherein each of said clamps comprises a strap having a primary end and a secondary end, said strap being curved between said primary and secondary ends of said strap such that said strap has a circular shape, said strap being divided into a first half being hingedly coupled to a second half, said strap being positioned in an open position having said primary end of said strap being spaced from said secondary end of said strap such that said strap receives said manifold, said strap being positioned in a closed position having primary end of said strap abutting said secondary end of said strap such that said strap wraps around an outer wall of said manifold.

12. The system according to claim 11, further comprising a receiver being coupled to said strap, said receiver having a distal end with respect to said strap, said receiver extending away from said manifold when said strap is wrapped around said manifold, said distal end of said receiver having a well extending toward said strap, said well having a bounding surface.

13. The system according to claim 12, further comprising a first fastener being pivotally coupled to said primary end of said strap, said first fastener engaging said secondary end of said strap to compress said strap around said manifold.

14. The system according to claim 12, further comprising a second fastener, said second fastener being extended through a selected one of said first and second apertures in said first member, said second fastener threadably engaging said bounding surface of said well such that said strap is coupled to said first member thereby facilitating said manifold to be coupled to said first member when said strap is wrapped around said manifold.

15. A seed drying system comprising:

a seed treater being configured to contain a plurality of seeds that have been coated with a liquid treatment, said seed treater having a housing and a drum being rotatably positioned within said housing, said drum having an aperture extending longitudinally through said drum wherein said aperture is configured to contain the seeds;

a manifold being positioned within said seed treater;

a fan being configured to selectively urge air, said fan being fluidly coupled to said manifold wherein said manifold is configured to direct the air over the seeds thereby facilitating the liquid treatment to dry on the seeds; and a mounting unit having said manifold being coupled thereto such that said mounting unit retains said manifold in a horizontal orientation, said mounting unit being releasably coupled to said housing such that said manifold is retained in said drum, said mounting unit centrally positioning said manifold in said aperture;

a housing having an outer surface; and a plurality of disks, each of said disks having a first surface and a second surface, said second surface corresponding to each of said disks being coupled said mounting unit, said first surface corresponding to each of said disks magnetically engaging said outer surface of said housing corresponding to said seed treater such that said mounting unit is releasably coupled to said housing.

16. The system according to claim 15, wherein:

said mounting unit includes a third member and a second member, said third member having a forward surface, said second member having a front surface; and said plurality of disks includes a first disk, a second disk and a third disk, said first disk being positioned on said forward surface of said third member, each of said third and second disks being positioned on said front surface of said second member.

17. A seed drying system comprising:

a seed treater being configured to contain a plurality of seeds that have been coated with a liquid treatment, said seed treater having a housing and a drum being rotatably positioned within said housing, said drum having an aperture extending longitudinally through said drum wherein said aperture is configured to contain the seeds, said housing having a first wall, said first wall having an opening extending into an interior of said housing, said drum being oriented having said aperture being aligned with said opening, said first wall having an outer surface;

a manifold being positioned within said seed treater, said manifold being positioned within said aperture in said drum, said manifold having a primary end end, a secondary end and an outer wall extending therebetween, said manifold being elongated between said first end and said second end, said outer wall being continuous such that said manifold has a cylindrical shape;

a fan being configured to selectively urge air, said fan being fluidly coupled to said manifold wherein said manifold is configured to direct the air over the seeds thereby facilitating the liquid treatment to dry on the seeds; and a mounting unit having said manifold being coupled thereto such that said mounting unit retains said manifold in a horizontal orientation, said mounting unit being releasably coupled to said housing such that said manifold is retained in said drum, said mounting unit centrally positioning said manifold in said aperture, said mounting unit comprising:

a first member having a first end and a second end, said first member being elongated between said first end and said second end, said first member having a top surface and a bottom surface, said first member having a first aperture extending through said top surface and said bottom surface, said first aperture being centrally positioned between said first end and said second end, said first member having a second aperture extending through said top surface and said bottom surface, said second aperture being positioned closer to said second end than said first aperture, a second member having a first end and a second end, said second member having a front surface and a back surface, said second member being elongated between said first end and said second end of said second member, said second member being coupled to said first member, said second member being oriented perpendicular to said first member, said second member being positioned closer to said first end of said first member than said second end of said first member such that said first and second members forms a cross, said first member being centrally positioned on said second member, said second member having a third aperture extending through said front surface and said back surface, said third aperture being positioned closer to said first end of said second member than said second end of said second member, said second member having a fourth aperture extending through said front surface and said back surface, said fourth aperture being positioned closer to said second end of said second member than said first end of said second member, a third member being coupled to and extending upwardly from an intersection between said first member and said second member having said third member being oriented perpendicular to each of said first member and said second member, said third member having a distal end with respect to said intersection, said third member having a rear surface and a forward surface, said third member having a fifth aperture extending through said rear surface and said forward surface, said mounting unit being positioned in said housing having said first member extending through said opening in said housing and being centrally positioned in said aperture in said drum having said first member being horizontally oriented in said drum, a pair of first supports, each of said first supports being coupled to and extending between said third member and said second member, each of said supports being positioned on opposite sides of said third member such that each of said supports inhibits said third member from laterally deflecting from said third member's perpendicular orientation, a second support, said second support being coupled to and extending between said third member and said first member such that said second support inhibits said third member from deflecting rearwardly and forwardly from said third member's perpendicular orientation, said second support being positioned on said rear surface of said third member such that said second support does not engage said housing, a plurality of clamps, each of said clamps being removably coupled to said first member, each of said clamps releasably engaging said manifold such that said manifold is retained on said first member having said manifold being oriented collinear with said first member, each of said clamps comprising:

a strap having a primary end and a secondary end, said strap being curved between said primary and secondary ends of said strap such that said strap has a circular shape, said strap being divided into a first half being hingedly coupled to a second half, said strap being positioned in an open position having said primary end of said strap being spaced from said secondary end of said strap such that said strap receives said manifold, said strap being positioned in a closed position having primary end of said strap abutting said secondary end of said strap such that said strap wraps around said outer wall of said manifold, a first fastener being pivotally coupled to said primary end of said strap, said first fastener engaging said secondary end of said strap to compress said strap around said manifold, a receiver being coupled to said strap, said receiver having a distal end with respect to said strap, said receiver extending away from said manifold when said strap is wrapped around said manifold, said distal end of said receiver having a well extending toward said strap, said well having a bounding surface, and a second fastener, said second fastener being extended through a selected one of said first and second apertures in said first member, said second fastener threadably engaging said bounding surface of said well such that said strap is coupled to said first member thereby facilitating said manifold to be coupled to said first member when said strap is wrapped around said manifold; and a plurality of disks, each of said disks having a first surface and a second surface, said second surface corresponding to each of said disks being coupled said mounting unit, said first surface corresponding to each of said disks magnetically engaging said outer surface of said housing corresponding to said seed treater such that said mounting unit is releasably coupled to said housing, said plurality of disks including a first disk, a second disk and a third disk, said first disk being positioned on said forward surface of said third member, each of said third and second disks being positioned on said front surface of said second member.

* * * * *